United States Patent [19]

Keller et al.

[11] Patent Number: 4,785,975

[45] Date of Patent: Nov. 22, 1988

[54] MANUALLY ACTUATED PUMP

[75] Inventors: Peter Keller; Jurgen Koch, both of Juchen-Gierath, Fed. Rep. of Germany

[73] Assignee: Bramlage Gesellschaft Mit Beschrankter Haftung, Lohne, Fed. Rep. of Germany

[21] Appl. No.: 2,790

[22] Filed: Jan. 13, 1987

[30] Foreign Application Priority Data

Jan. 13, 1986 [DE] Fed. Rep. of Germany ..... 3600680

[51] Int. Cl.[4] ..... B67D 5/42

[52] U.S. Cl. ..... 222/321; 222/385; 417/512

[58] Field of Search ..... 222/321, 383, 385; 239/333; 417/512, 513, 520

[56] References Cited

U.S. PATENT DOCUMENTS

| | | | |
|---|---|---|---|
| 3,877,616 | 4/1975 | Stevens | 222/321 |
| 3,877,617 | 4/1975 | Stevens | 222/321 |
| 4,089,442 | 5/1978 | Hafele et al. | 222/321 |
| 4,113,145 | 9/1978 | Meshberg | 222/321 |
| 4,122,982 | 10/1978 | Giuffredi | 222/321 |
| 4,169,546 | 10/1979 | Yuhas et al. | 222/385 |

*Primary Examiner*—H. Grant Skaggs

*Attorney, Agent, or Firm*—Collard, Roe & Galgano

[57] ABSTRACT

A manually actuated pump that dispenses liquid substances in measured quantities from the contents of bottles and containers which is comprised of a handle capable of being axially displaced against the action of a spring, a cylinder having a pump space whose volume is reduced on manual actuation of the handle, a feed tube connected to the cylinder, a piston driven by the handle that displaces the volume in the cylinder, and two valve-closing surfaces for alternately opening and closing the passage leading to the feed tube and the discharge duct contained in the handle so that only a known measured quantity of liquid will be dispensed from the bottle.

3 Claims, 9 Drawing Sheets

MANUALLY ACTUATED PUMP

BACKGROUND OF THE INVENTION

This invention relates to a manually actuated pump which dispenses liquids in measured quantities from the contents of bottles or other containers. The pump is comprised of an actuating handle capable of being axially displaced against the action of a spring, a pump space having its volume reduced on manual actuation, a feeder tube connected therewith, and two valve-closing surfaces that, as a function of the displacement of the actuating handle, alternately open and close the passage leading to the feed tube and the discharge duct of the pump.

Pumps of the above type are known from German design patent DE-GM No. 81 38 264, and comprises two individual valves-namely, a valve flap molded to match the vertical tube, and a lip-shaped valve connected to the discharge duct. Under excess pressure in the pump space, the lips lift from each other, and join each other again during the intake or suction stroke. The functional reliability of such a pump is highly dependent upon the degree of viscosity of the contents to be dispensed. For example, a pasty compound may impair the function of the valve.

Accordingly, it is an object of the invention to design a manually actuated pump with greater functional reliability, thereby allowing a wider range of application to products of varying viscosity.

SUMMARY OF THE INVENTION

The foregoing and related objects are achieved according to the invention by providing a manually actuated pump whose valves open and close depending on the displacement motion of an actuating handle. The pump, according to the invention, is designed as follows: Two valve-closing surfaces are provided on one single valve-closing body, which is driven or carried along through friction grip by a piston. The piston, in turn, is driven by an actuating handle, in a manner such that during the initial downward stroke (which reduces the volume of the pump space), the valve-closing body gets carried along into a closing position sealing the feed tube. The valve-closing body is subsequently run over by the piston which, in the course of a spring-actuated return stroke, is returned by the valve-closing body into a position sealing the discharge duct. Displacing the handle causes spontaneous dispensing of the contents of the container without any delay taking place, as it is the case with pumps using bellows. The spring-actuated resetting of the piston can be adjusted by selecting the spring force as the pump is being assembled, taking into account the viscosity. The valve-closing body, in addition to joining the valve-closing surfaces on a single component, has another advantageous function is that it forms the stop means for the spring-loaded return movement of the piston. Furthermore, it was found that it is advantageous to design the valve-closing body in the form of a perforated transverse disk.

The disk is disposed in the piston with friction grip across its circumference and arranged on the feed tube with an inner hub cavity with limited displacement capability. The valve-closing body is designed so that its valve-closing surfaces open and close to correspond to two transverse openings in the feed tube which are alternately opened and closed by the wall of the hub cavity. The perforated transverse disk permits the contents to pass through, while the body of the piston guides the disk without tilting. In addition, the hub cavity, acting as a slide, contributes to the positioning of the transverse disk within its center area. The stop means defining the closing and opening positions is formed by an intermediate segment of the vertical tube with a smaller cross section, such limitation extending between the two transverse openings of a separating wall. The contents pass around this separating wall according to the alternating release by the transverse disk. Furthermore, it was found that it is favorable if the piston is designed as a pot with its bottom disposed at about the level of the transverse opening leading to the discharge duct when the pump is in the discharge position. The piston, in this position, rests on the annular surface of the perforated transverse disk which slopes down to the level of a transverse opening plus the thickness of the wall conform to the axial length of the hub cavity. In this way, the change from one position into the other takes place in the shortest possible way.

Another embodiment of the pump is obtained if the valve-closing body is designed in the form of a segment that is disposed adjacent to an extended piston rod. The segment is carried along by the piston by means of friction. The segment is designed to join and seal the valve seat areas of the discharge duct and the rising tube. This embodiment, which is outside the truly rotation-symmetrical design, has been simplified in design. The valve-closing body extends only partially across the pump space area. This leaves free a large remaining zone or area through which the contents to be discharged can pass with favorable flow characteristics. Such association permits another embodiment in that friction grip is accomplished between the area of the segment and the surface of the leg of the piston rod which is designed with a T-shaped cross section. The surface faces the area, and the piston rod extends from the piston in the direction of the bottom of the pump space. In order to keep the cross section of the flow path as large as possible, and to assure smooth guidance of the piston rod, the piston rod is provided with projections that guide it along the inner wall of the pump. Finally, another advantageous feature is that the leg surface of the piston rod is fitted with driving pawls that can be cleared by the valve-closing body. In this way, the valve-closing body is always safely carried along, even under extreme conditions.

Other objects and features of the present invention will become apparent from the following detailed description when taken in connection with the accompanying drawings which disclose two embodiments of the invention.

BRIEF DESCRIPTION OF THE DRAWINGS

In the drawings, wherein similar reference numerals denote similar elements throughout the several views.

DETAILED DESCRIPTION OF THE PREFERRED EMBODIMENTS

Figure 1:
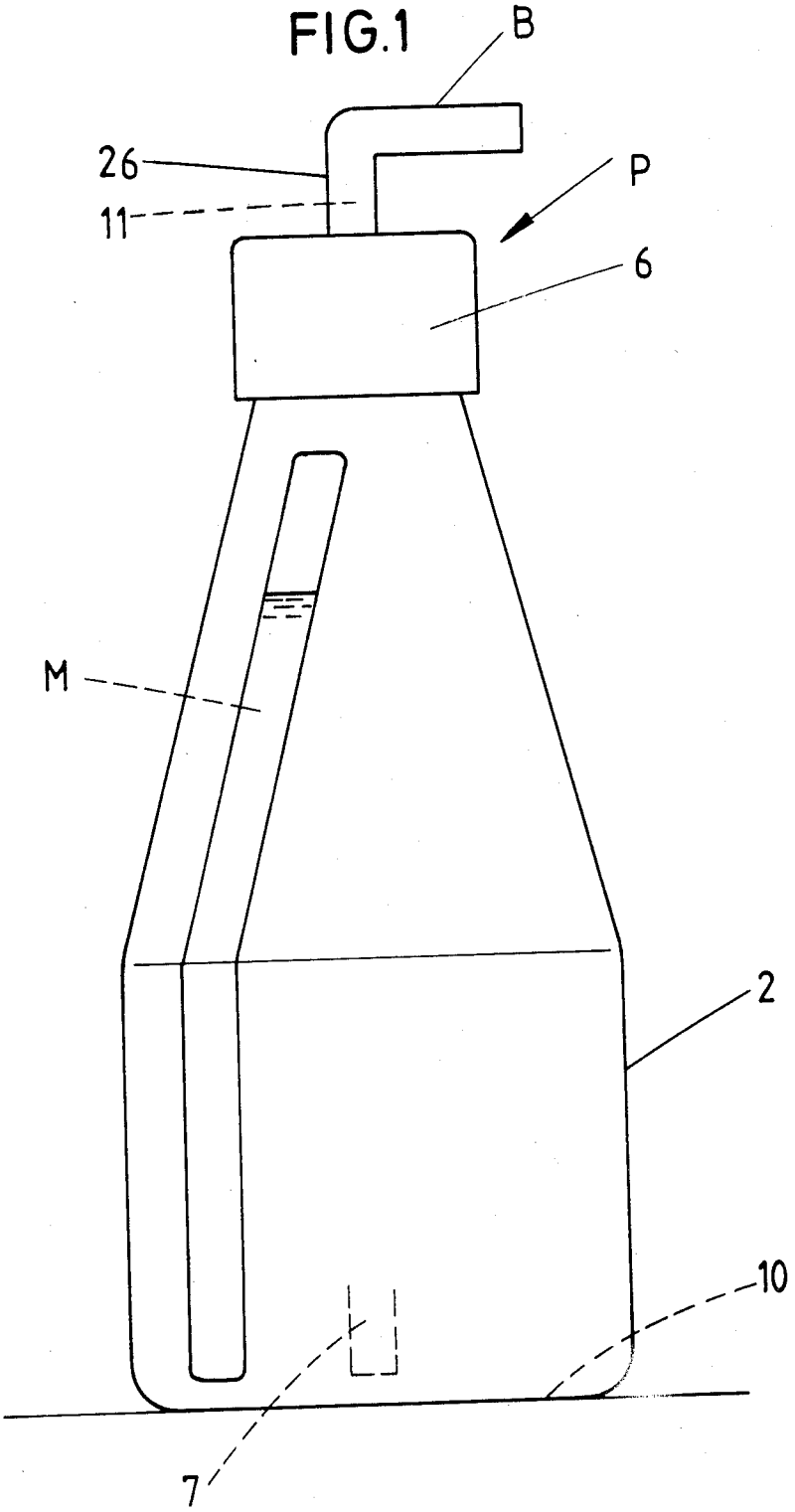
FIG. 1 shows a lateral view of a dispenser equipped with the pump according to the first embodiment of the invention.
Figure 2:
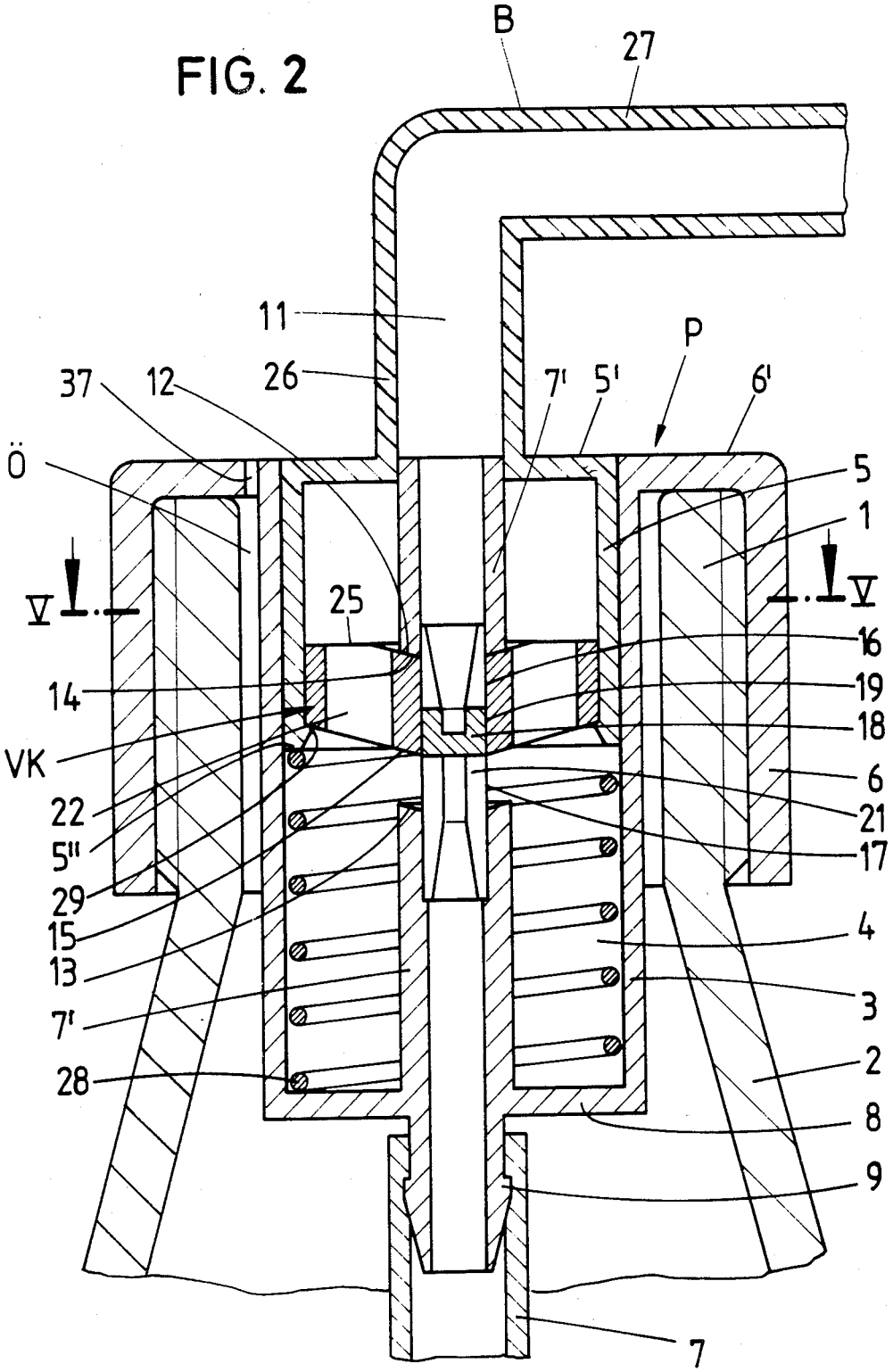
FIG. 2 shows a vertical cross section through the head of the dispenser of FIG. 1, with the pump dispensing mechanism in a normal position.

Referring now in detail to the drawings and, in particular, to FIGS. 1 and 2, there is shown a first embodiment of a novel pump generally designated as "P", and being screwed onto the threaded throat 1 of a bottle 2.

In FIG. 2, the pump's cylinder 3 freely projects into the opening "O" of the bottle throat 1. A piston 5 is guided with axial displacement in the pump space 4 of cylinder 3. To fix the pump "P", cylinder 3 is extended into a cap 6 overlapping the mouthpiece of the throat of the bottle, such cap having the matching counterthread for the screw attachment. The pump space 4 is communicatively connected with cylinder 3 by way of a rising or feed tube 7 which extends to the bottom 10 of the bottle 2. The tube may be molded to match cylinder 3 on the bottom side, or, as shown, plugged over a short pipe 9 that is molded on the bottom 8 of cylinder 3 or pump space 4.

Within pump space 4, a valve-closing body "VK" is disposed between discharge duct 11, which, for the first embodiment, forms the top side of the actuating handle "B", and feed tube 7. In this embodiment, the valve-closing body is supported with friction grip in a piston 5 designed with the shape of a pot, said body alternately opening and closing the passage to feed tube 7 and discharge duct 11 as a function of the displacement of the actuating handle. Passage through discharge duct 11 occurs via valve seat surface 1. A second valve seat surface 13 is disposed on the feed tube 7 or on a tube segment 7', the latter extending the length of feed tube 7 centrally within pump space 4.

The valve-closing surface of valve-closing body "VK", which cooperates with the valve seat surfaces 12 and 13 with sealing effect, are formed on the body "VK", that is, on a single component of the pump. The valve-closing surface of the valve-closing body "VK" cooperating with the valve seat surface 12 on the side of the discharge duct is denoted by the reference numeral 14, and the one on the side of the rising tube is denoted by reference numeral 15.

Viewed in the axial direction, valve seat surfaces 12, and 13 are joined by the window-like transverse openings 16 and 17, respectively. The transverse opening 16 on the side of the actuating handle represents the flow connection between pump space 4 and discharge duct 11; transverse opening 17 communicatively connects pump space 4 with feed tube 7. A separating wall 18 interrupting the direct path of through-flow in tube segment 7' extends between the two transverse openings 16 and 17. Thus, the medium to be dispensed is forced to pass through pump space 4.

The window frame of transverse openings 16 and 17 is included in valve seat surfaces 12 and 13, respectively, which means that the inner hub cavity 19 of the valve-closing body "VK", which, in the present embodiment, is formed by a transverse disk 20, participates in the sealing closure. The wall of hub cavity 19 is supported with limited displacement on an intermediate segment 21 of rising tube 7 or rising tube segment 7', such intermediate segment 21 having a reduced cross section. The transverse openings 16, 17 are alternately closed by the wall of hub cavity 19.

Figure 5:
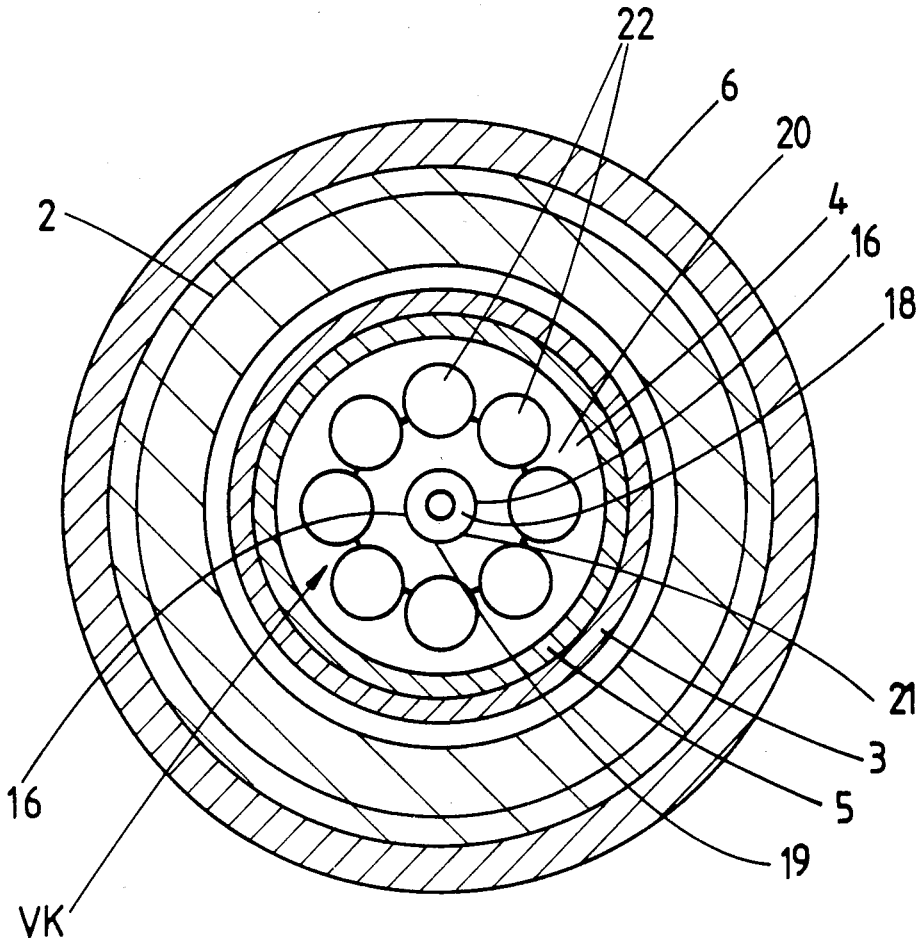
FIG. 5 is a cross-sectional view taken along line V—V of FIG. 2.

The transverse disk 20 is perforated for the purpose of passing the medium to be dispensed from one side of transverse disk 20 to the other. In the present embodiment, the disk is a perforated rim. The individual holes 22 are disposed with equal angular spacings between each other (see FIG. 5).

The movement of transverse disk 20 is stopped once the above-described reduction in cross section of the intermediate segment 21 occurs. The top and bottom sides of transverse disk 20 have a flat, truncated cone-shaped configuration in the same direction, at the bottom, across the total surface, and at the top, across an inner center area. The tapering is directed in a downward direction.

The pot bottom 23 of pot-shaped piston 5 forms the top driving stop for transverse disk 20. In the end position of the pump (FIG. 3), pot bottom 23 extends approximately at the level of transverse openings 16 leading to discharge duct 11. the sloping center area of the top side of transverse disk 20 allows for transverse openings 16 to be in flow connection with pump space 4 via the wedge zones 24 and the holes 22. The adjacent peripheral ring surface 25 of transverse disk 20 starts approximately in the circular ring of the hole radii. The centrally sloping area of the wide surface of the top side of transverse disk 20 is flush with the bottom edge of transverse openings 16. The top edge of these transverse openings 16 extends with a corresponding inclination, which, when reversed, applies to the bottom side of the transverse disk. In this configuration, the bottom edge of transverse opening 17 conforms to the conically sloping bottom side of the transverse disk.

Short tube 26 has a top side which extends into a bent crosswise exit tube 27 that starts from the top side of bottom 23 of piston 5. Short tube 26, which is molded to match the bottom of the piston, forms discharge duct 11. The spacing of the curvature takes into account the stroke of the piston, so that top side 6' of cap 6 forms the stop to limit the displacement of the actuating handle when it impacts with the bottom side of the exit tube 27.

Feed tube 7 or segment 7' forming such tube in pump space 4 extends into discharge duct 11. This allows it to be flush with top side 6' of cap 6 or with the top side 5' of pot-shaped piston 5.

Piston 5 is subjected to the force of a spring 28 loading the piston in the direction of its basic position (see FIG. 2). In the first embodiment, such spring is designed in the form of a screw thread-type pressure spring that is supported on the end of bottom 8 and which loads the surface edge 5'' of the piston with its terminal spring winding, the latter facing the piston.

In the basic position, the stop limitation is provided by valve-closing body "VK", which, in the normal position, drives with its hub against the stationary stop surface forming valve seat surface 12. Subsequently, piston 5 is supported on the outer bottom edge of transverse disk 20. The inside of the edge of the pot forms a stop shoulder 29. The stop shoulder has a bevelled lead edge, so that piston 5 can be mounted on the transverse disk without any problem.

Figure 3:
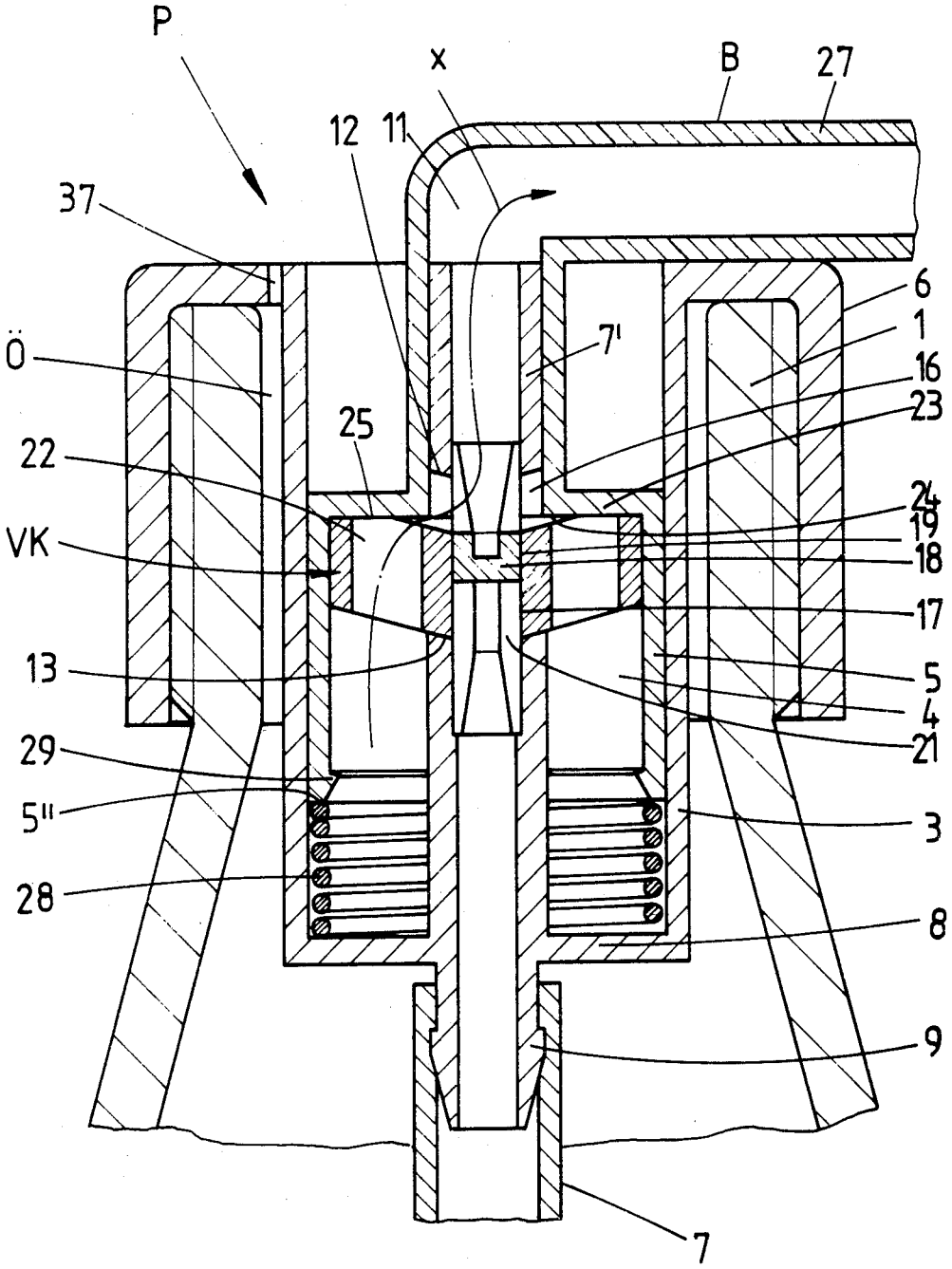
FIG. 3 shows the sectional view of FIG. 2 with the pump in the discharge position.
Figure 4:
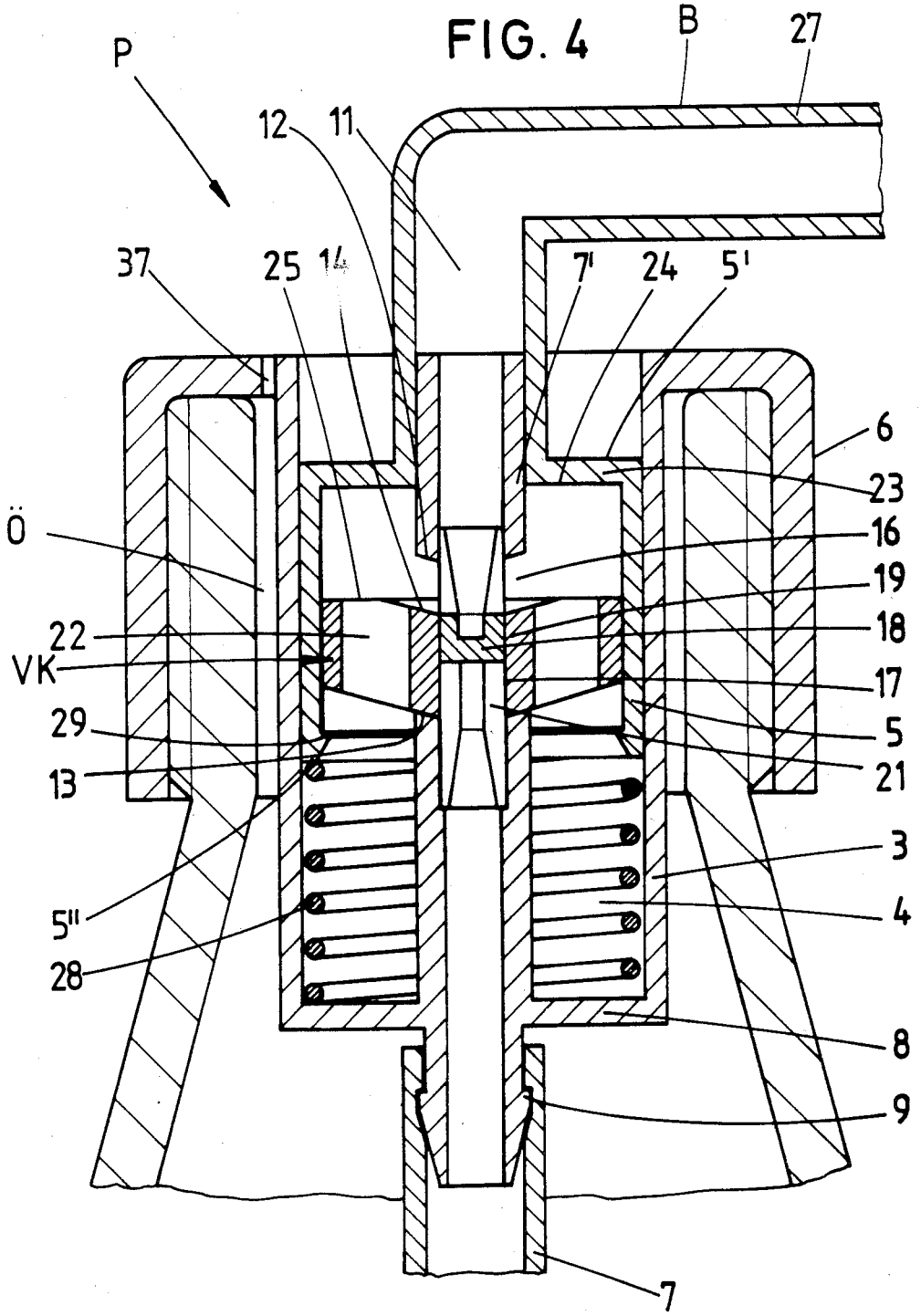
FIG. 4 is a cross-sectional view of the pump in an intermediate discharge position.

The operation of the pump is explained as follows: The medium to be dispensed, which is present in pump space 4 as a result of a preceding actuation of the pump, is forced into discharge duct 11 due to the downward displacement of piston 5 by means of the actuating handle "B". This occurs because the displacement caused a reduction in the volume of pump space 4 with a subsequent passing of the liquid through holes 22 of the transverse disk and top transverse openings 16. The liquid is finally discharged by way of the exit tube or orifice 27 of discharge duct 11. In order to obtain this discharge, which is denoted by the letter "x" in FIG. 3, the valve-closing body "VK", guided by friction grip on the inner wall of the piston, is carried along, that is to say, it is driven from the position in which it closes (FIG. 2) top transverse openings 16, into the position according to FIG. 4. During this intermediate actuation stage of the actuation handle, the valve-closing body "VK" shifts into the position in which it closes or seals rising tube 7, i.e., hub cavity 19 of transverse disk 20, with its inner surface, closes bottom transverse openings 17. Thus, the medium present in pump space 4 cannot be displaced back into the rising tube. The piston 5 subsequently moves into the intermediate position shown in FIG. 4, while it runs over valve-closing body "VK". Under maximum stroke of actuation, the bottom 23 of the piston comes to rest on its inner surface on the annular surface 25 of transverse disk 22 (FIG. 3). When actuating handle "B" is released, piston 5 is reset through friction grip to the position sealing discharge duct 11, such resetting taking place in the initial phase of the spring-actuated return stroke. This stroke acts as an intake stroke with the next portioned amount of liquid being sucked into pump space 4 from the supply space of the bottle via rising tube 7.

The pump according to the second embodiment is basically in conformity with the solution described above. The reference numerals are used where required for the explanation of the second embodiment and where conformity exists, without repeating text portions to some extent. In the second embodiment, the valve-closing body "VK" is designed as a segment that, with its circular jacket surface, guides itself on the inner wall of cylinder 3. Within the area of its surface 30, it rests against a piston rod 31, by which it is carried along through friction grip. The widest possible surface contact has been selected so as to assure the above driving effect through friction grip. The piston rod 31 extends from the bottom side of piston 5, which, in the present embodiment, has the shape of a disk. The running surface 32 of this disk is recessed towards the center plane in the form of a pan, so that the edge zones form the lips 32'.

The piston rod has a T-shaped cross section, whereby the leg area 33 rests against the edge surface 30 of the segment. The ends of leg area 33 are recesssed from the inside wall of cylinder 3 across the major part of their lengthwise extension, so that the medium to be dispensed can pass through the zone of the piston rod in the direction of the discharge duct 11. Only within the lower piston end zone do the projections 34 protrude beyond the face sides of leg area 33 that extend up to the inner wall of cylinder 3. The projections, in this way, support the end of the piston rod within that zone in a controlled manner. The U-bridge of the T-profiled piston of the piston rod 31 is designed with a matching shape.

Figure 6:
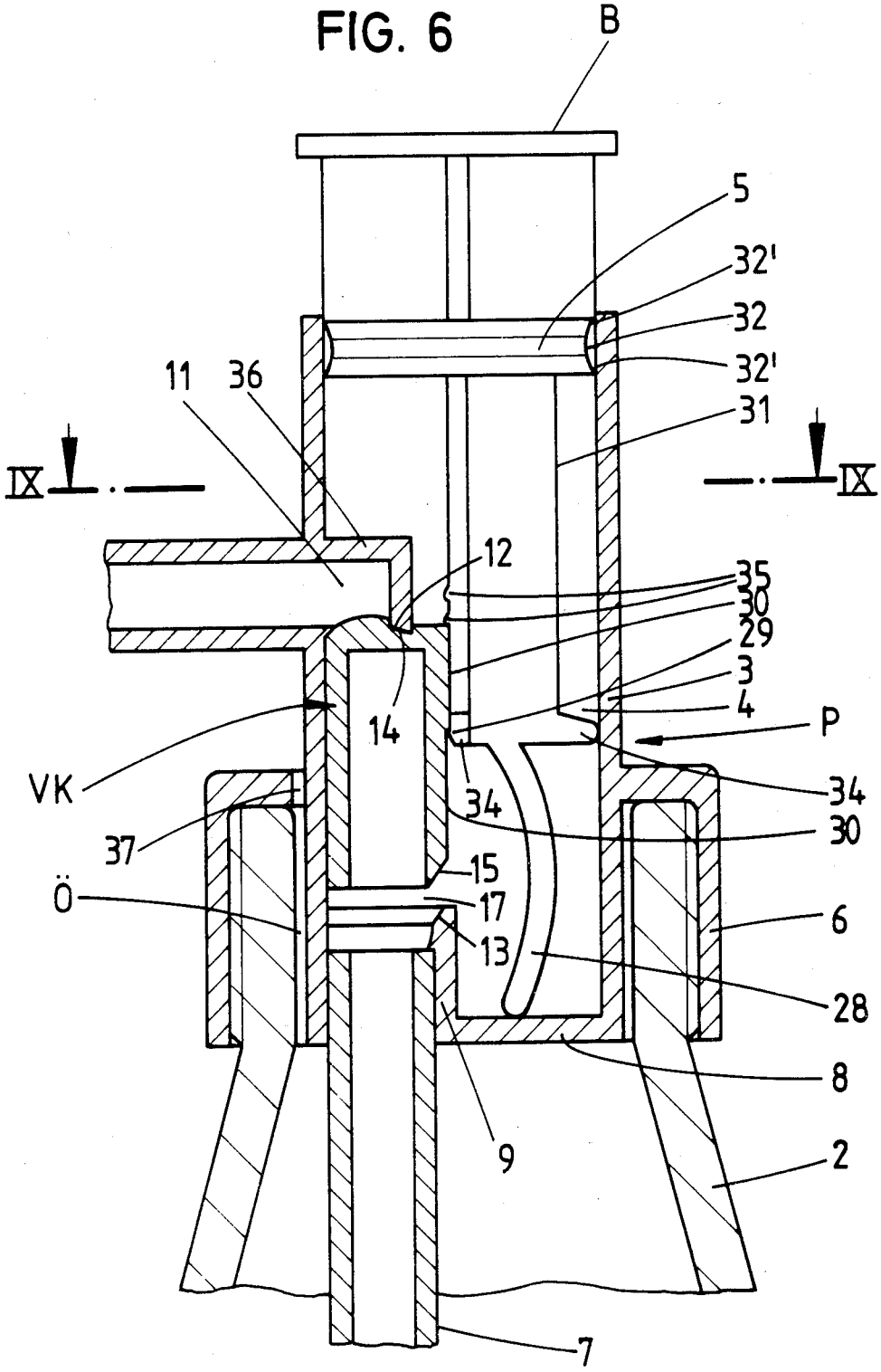
FIG. 6 is a vertical cross sectional view of another embodiment of the pump in the normal position.
Figure 7:
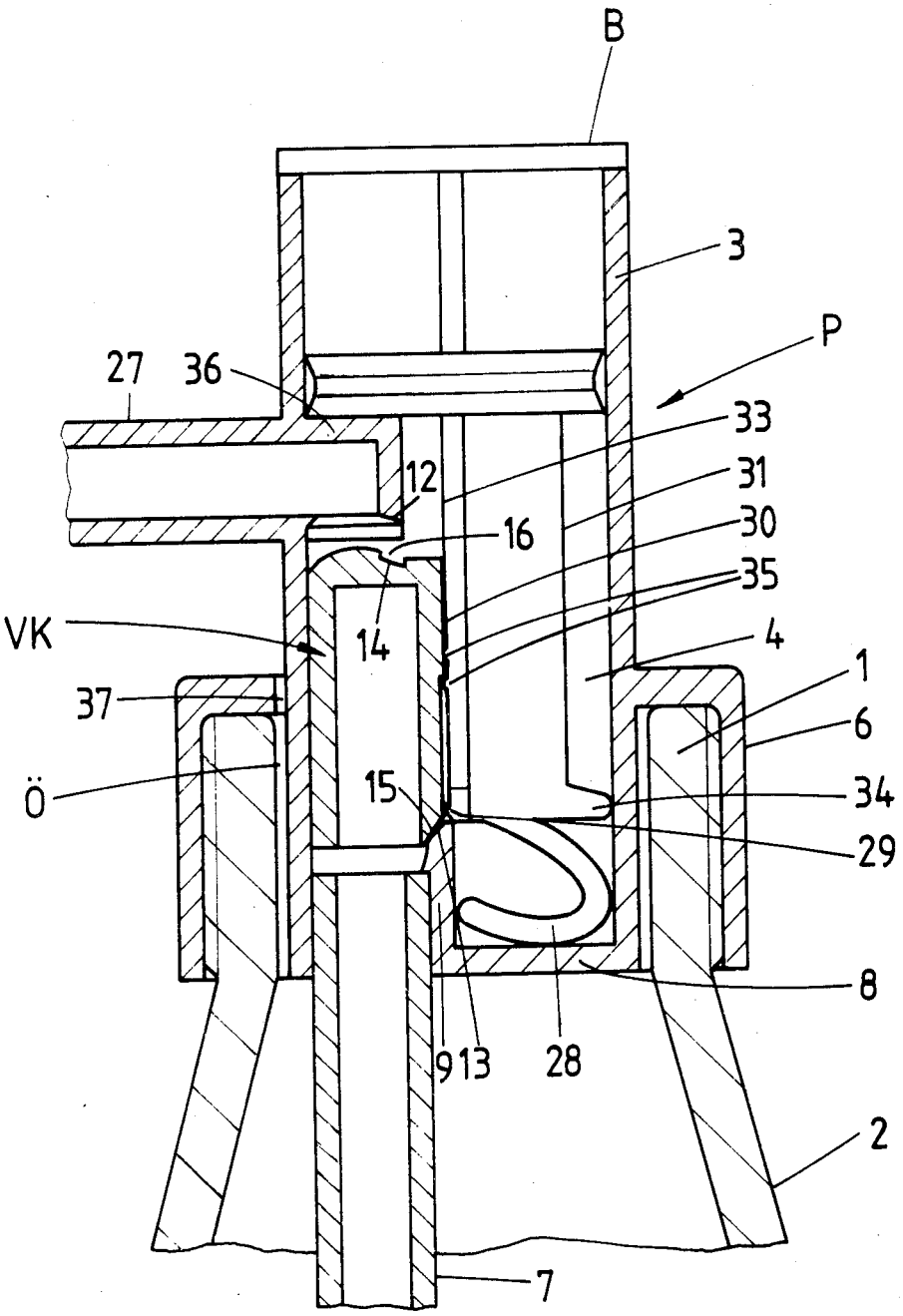
FIG. 7 shows the pump of FIG. 6 in the dispensing position.

In the present embodiment, the spring 28 is an integral component of the piston rod 31 that acts as a spring tongue supporting itself on the bottom 8 of the pump space 4. FIG. 7 shows that a piston 5 is displaced in a downward direction, this spring tongue curls up, or rolls in, and, on release of the actuating handle "B", it resets itself in the basic position shown in FIG. 6.

For material saving reasons, valve-closing body "VK" is designed with the shape of a pot with a downwardly directed opening pointed at feed tube 7. At its top side, the pot bottom forms the valve-closing surface 14 facing the discharge duct 11, and with its edge, the valve seat surface 15 facing the feed tube 7.

In this embodiment, valve-closing body "VK" is also used to form the stop for the spring-loaded return movement of piston 5 in that the latter, in the normal position (see FIG. 6), is flanged from the bottom by a stop shoulder 29 disposed on the side of the piston rod. The matching countershoulder is disposed on surface 30.

The leg area 33 of the T-shaped piston rod 31 facing surface 30 has projections serving as driving pawls 35 for increasing the friction grip between surface 30 and leg area 33.

The end position of the pump (FIG. 6) is reached when piston 5 comes to reset against the short pipe-like projection 66 which projects crosswise into pump space 4 and forms at its underside the valve seat surface 12, thereby allowing the piston to come into rest against the top side of such projection. At the top side, the piston changes into a cross profile end with a plate forming the actuating handle "B", said plate coming into contact with the face edge of cylinder 3. In this way, an effective second stop surface can be used for the basic position.

In the present embodiment, feed tube 7 is accommodated in a short pipe 9 pointed inwardly from bottom 8 of cylinder 4. In this case too, the feed tube 7 can be molded together with short pipe 9, matching the latter.

Figure 8:
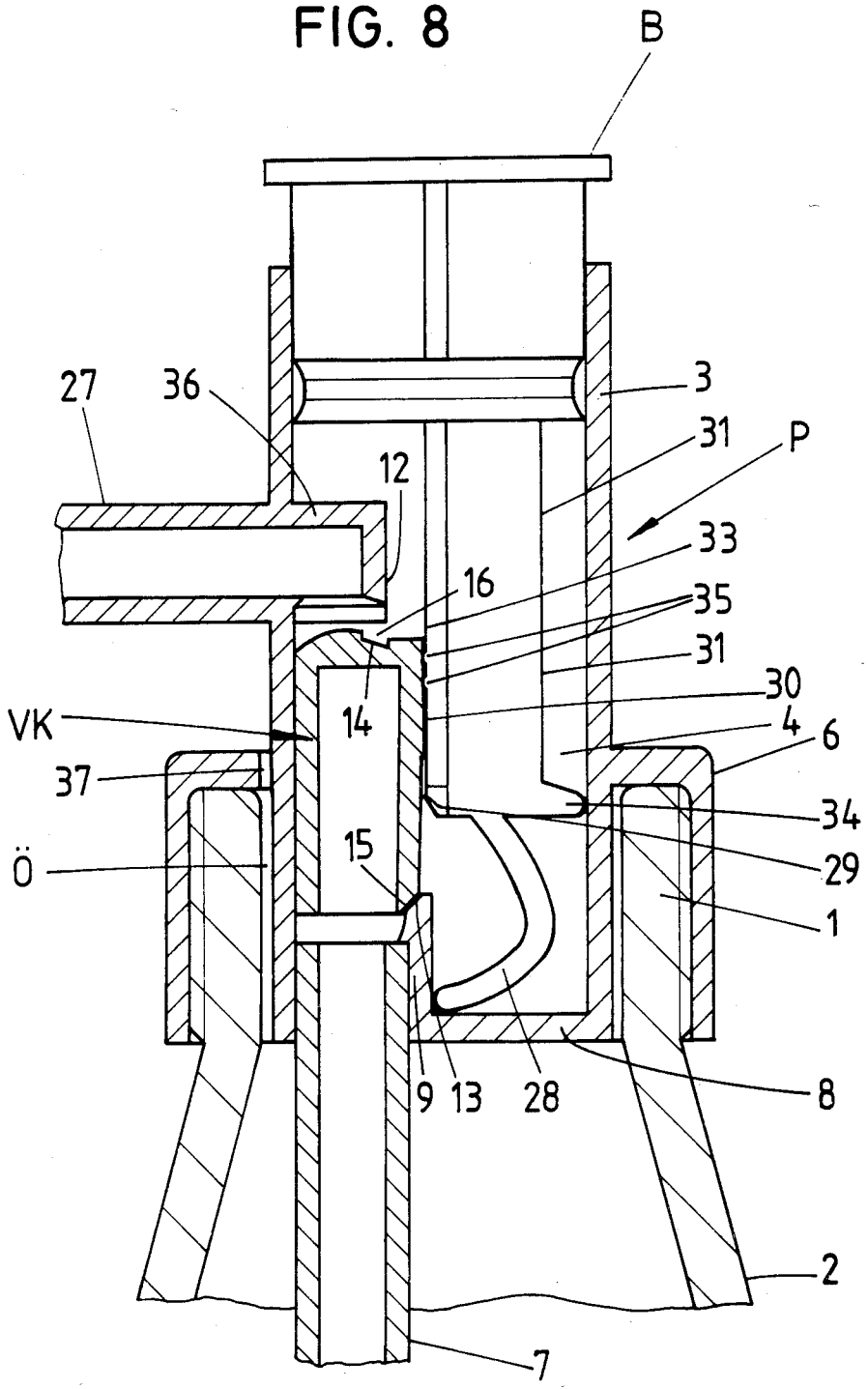
FIG. 8 shows the pump of FIG. 6 in an intermediate discharge position.
Figure 9:
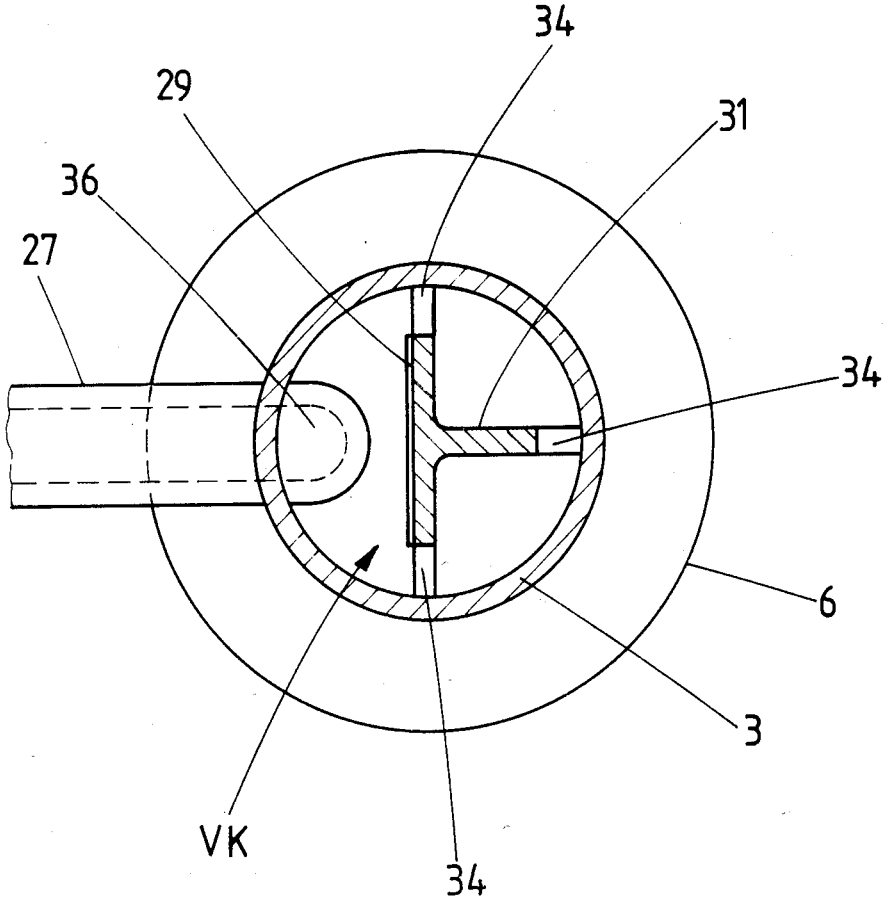
FIG. 9 is a cross-sectional view taken along line IX—IX of FIG. 6.

The function of this pump embodiment is explained as follows:

Valve-closing body "VK" is carried along through friction grip by the piston which has been driven by the actuating handle in a downward direction. This causes the valve-closing device to be driven into a closing position sealing feed tube 7. In the present embodiment, the force-transmitting element is formed by piston rod 31. Feed tube 7 is closed, and transverse opening 16 is opened, so that piston 5 is displaced further in a downward direction (see FIG. 8). When actuating handle "B" is released, the spring causes the piston to be returned to its basic position as shown in FIG. 6. When this occurs, top transverse opening 16 closes and bottom transverse opneing 17 opens, causing a portion of liquid to be sucked or drawn into pump space 4 as a result of the intake stroke.

An opening 37 in cap 6 provides air compensation with respect to the interior space of the bottle, for which purpose cylinder 3 extends with a radial spacing relative to the inside wall of the throat of the bottle.

While only two embodiments of the present invention have been shown and described, it is obvious that many changes and modifications may be made thereunto, without departing from the spirit and scope of the invention.

What is claimed is:

1. A manually actuated pump that dispenses liquids in measured quantities from the contents of bottles and containers, comprising:

a handle capable of being axially displaced;

a piston connected to the handle and capable of being displaced by the handle;

a cylinder, for slidably receiving said piston, and having a pump space whose volume is capable of being displaced by said piston;

a spring, disposed in said cylinder and in contact with said piston during displacement of said pump space, said spring returning said piston to its position in the cylinder before said piston was displaced by said handle;

a feed tube connected to said cylinder; and a valve-closing body comprising a perforated disc disposed transverse to said pump space, said perforated disc having an inner hub cavity for sliding engagement with said feed tube, said sliding engagement activated by the piston which moves in said cylinder and said valve-closing body having two valve-closing surfaces for alternately opening and closing passages leading from said cylinder to said feed tube and from said cylinder to a discharge duct, said valve-closing body is driven through friction grip by said piston so that during a displacement of said handle and subsequent volume reduction of said pump space, said valve-closing body is carried along by the movement of said piston into a closing position sealing said feed tube with the first of said valve-closing surfaces and opening said passage leading to said discharge duct, and during the return stroke of said handle and the subsequent volume increase of said pump space, said body moves into a position to seal said discharge duct with the second of said valve-closing surfaces and opens said passage leading to said feed tube, said valve-closing body further including a means for stopping said spring return of said piston in said position in the cylinder before the displacement thereof by said handle.

2. The manually actuated pump as defined in claim 1, wherein a stop is formed by an intermediate segment on said feed tube, and a separating wall extending between the two transverse openings.

3. A manually actuated pump that dispenses liquids in measured quantities from the contents of bottles and containers, comprising:

a handle capable of being axially displaced;

a hollow cylindrical piston having one open end and having an opposite end connected to said handle, said piston capable of being displaced by the handle to a predetermined position in said cylinder;

a cylinder for slidably receiving said piston, and having a pump space whose volume is capable of being displaced by said piston;

a spring, disposed in said cylinder and in contact with said piston during displacement of said pump space, said spring returning said piston to its position in said cylinder before said piston was displaced by said handle;

a feed tube connected to said cylinder;

a valve-closing body comprising a perforated disc mounted transversely within said hollow piston and activated by the piston as it moves in said cylinder and having two valve-closing surfaces for alternately opening and closing passages leading from said cylinder to said feed tube and from said cylinder to a discharge duct; and said opposite end of said piston when said piston is in said predetermined position in said cylinder after said piston is displaced by said handle is disposed approximately at the level of said passage leading to said discharge duct, said opposite end of said piston coming to rest on an annular surface of said perforated disc, said annular surface of said disc sloping towards the center thereof in a direction away from said opposite end of said piston.

* * * * *